US006716002B2

(12) United States Patent
Higashino

(10) Patent No.: US 6,716,002 B2
(45) Date of Patent: Apr. 6, 2004

(54) MICRO PUMP

(75) Inventor: Kusunoki Higashino, Osaka (JP)

(73) Assignee: Minolta Co., Ltd., Osaka (JP)

( * ) Notice: Subject to any disclaimer, the term of this patent is extended or adjusted under 35 U.S.C. 154(b) by 51 days.

(21) Appl. No.: 09/855,371

(22) Filed: May 15, 2001

(65) Prior Publication Data

US 2002/0009374 A1 Jan. 24, 2002

(30) Foreign Application Priority Data

May 16, 2000 (JP) ..... 2000-143124

(51) Int. Cl.[7] ..... F04B 17/00; F04B 49/00; F04B 39/00

(52) U.S. Cl. ..... 417/413.2; 417/413.3; 417/212; 417/557

(58) Field of Search ..... 417/413.2, 413.3, 417/212, 322, 557

(56) References Cited

U.S. PATENT DOCUMENTS

| | | | | |
|---|---|---|---|---|
| 5,406,318 A | | 4/1995 | Moore et al. | 347/70 |
| 6,116,863 A | * | 9/2000 | Ahn et al. | 417/322 |
| 6,126,140 A | * | 10/2000 | Johnson et al. | 251/129.01 |
| 6,247,908 B1 | * | 6/2001 | Shinohara et al. | 417/413.2 |
| 6,458,325 B1 | * | 10/2002 | Roscher et al. | 422/68.1 |

FOREIGN PATENT DOCUMENTS

| | | | |
|---|---|---|---|
| DE | 196 48 694 C1 | * | 4/1998 |
| EP | 0949418 | * | 10/1999 |
| JP | 10-110681 A | | 4/1998 |
| JP | 10-299659 A | | 11/1998 |
| JP | 11-257233 A | | 9/1999 |

OTHER PUBLICATIONS

Wouter van der Wijngaart, Helene Andersson, Peter Enoksson, Kjell Noren and Göran Stemme, "The First Self–Priming and Bi–Directional Valve–Less Diffuser Micropump for Both Liquid and Gas", *Department of Signals, Sensors and Systems Royal Institute of Technology*, S–10044 Stockholm, Sweden, IEEE International Workshop on Micro Electromechanical Systems, Jan. 2000, pp. 674–679.

* cited by examiner

*Primary Examiner*—Charles G. Freay
*Assistant Examiner*—Michael K. Gray
(74) *Attorney, Agent, or Firm*—Sidley Austin Brown & Wood LLP

(57) ABSTRACT

The micro pump 100 comprises a first flow pass 115 for changing the flow pass resistance in accordance with the differential pressure, a second flow pass 117 wherein the percentage change in flow pass resistance relative to the differential pressure is less than that of the first flow pass 115, pressure chamber 109 connected to the first flow pass 115 and the second flow pass 117, and a piezoelectric element 107 for changing the pressure within the pressure chamber 109 so as to transport minute amounts of fluid with high precision using a simple construction. The ratio of the flow pass resistance of the first flow pass 115 and the flow pass resistance of the second flow pass 117 differs by changing the pressure within the pressure chamber 109 via the piezoelectric element 107, such that fluid can be transported in a standard direction and an opposite direction.

65 Claims, 9 Drawing Sheets

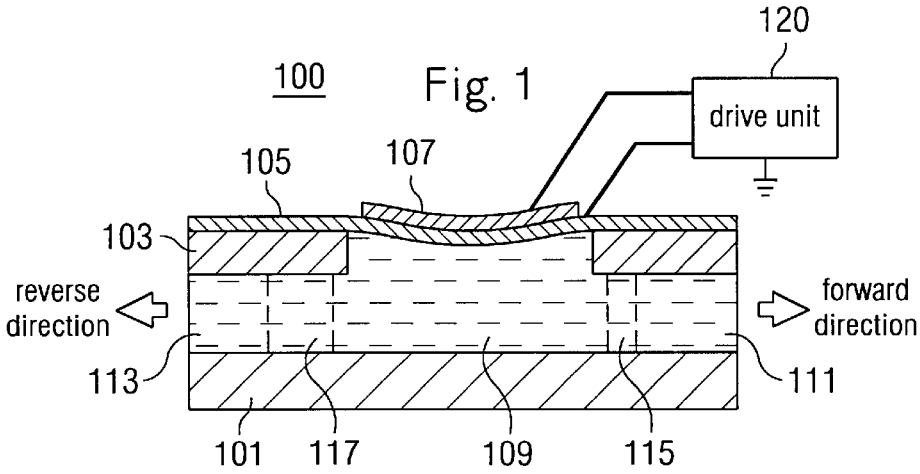
Fig. 2
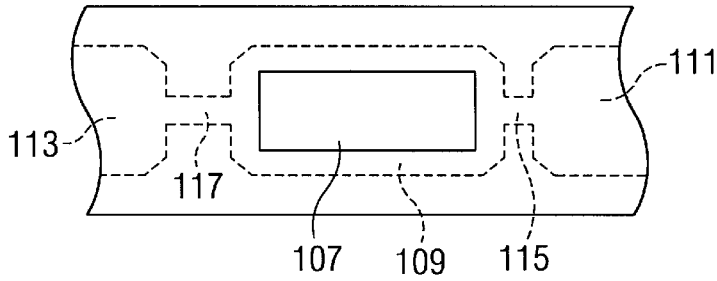

MICRO PUMP

This application is based on Patent Application No. JP2000-143124 filed in Japan, the content of which is hereby incorporated by reference.

BACKGROUND OF THE INVENTION

1. Field of the Invention

The present invention relates to an improved micro pump, and specifically relates to a micro pump for transporting minute amounts of fluid with high accuracy.

2. Description of the Related Art

The principal methods used by micro pumps to transport minute amounts of fluids include a first method using a mechanical check valve, and a second method using, in place of the check valve, a nozzle having different flow pass resistances in accordance with the fluid flow directions. A micro pump using the first method is disclosed in Japanese Laid-Open Patent Application No. HEI 11-257233, wherein a fluid is pressurized within the pump by operating a diaphragm, and this pressure is used to operate a check valve to transport the fluid. Japanese Laid-Open Patent Application No. HEI 10-299659 discloses a micro pump provided with movable valves in a nozzle unit communicating with a pressure chamber, wherein a piezoelectric element is used to open and close each of the movable valves to provide directionality to the flow of the fluid.

Japanese Laid-Open Patent Application No. HEI 10-110681 discloses a micro pump using the second method provided with projecting members in a nozzle unit communicating with a pressure chamber so as to have different flow pass resistances depending on the directions of the flow. This micro pump makes it difficult for fluid to start flowing in the opposite direction to a desired flow direction, such that the fluid is transported in one desired direction.

Since micro pumps using the first method are provided with check valves or movable valves, such micro pumps are mechanically complex, and readily susceptible to mechanical deterioration. Furthermore, the micro pump disclosed in Japanese Laid-Open Patent Application No. HEI 10-299659 requires at least three piezoelectric elements, including piezoelectric elements to operate the movable valves, and a piezoelectric element to change the pressure of the pressure chamber. A further disadvantage arises in that as these piezoelectric elements are operated individually, the drive circuits are complex.

Micro pumps using the second method can only transport a fluid in a single direction.

OBJECTS AND SUMMARY

An object of the present invention is to provide an improved micro pump to eliminate the previously described disadvantages. More specifically, the present invention provides a micro pump which is capable of transporting minute amounts of fluid in both forward and reverse directions with high accuracy using a simple construction.

These and other objects are attained by one aspect of the present invention providing a micro pump comprising a first flow pass which changes flow pass resistance in accordance with a differential pressure, a second flow pass wherein the percentage change in the flow pass resistance corresponding to a differential pressure is smaller than that of the first flow pass, a pressure chamber connected to the first flow pass and the second flow pass, and an actuator for changing the pressure force within the pressure chamber. The differential pressure referred to herein is the pressure force at bilateral ends of a flow pass.

According to this aspect, the first flow pass has a resistance which changes in accordance with a differential pressure, and the percentage change in the resistance of the second flow pass corresponding to the differential pressure is smaller than that of the first flow pass. Accordingly, the ratio of the resistance of the first flow pass to the resistance of the second flow pass is different when the differential pressure is large and when the differential pressure is small. Since the actuator changes the pressure force within the pressure chamber connected to the first flow pass and the second flow pass, the ratio of the flow pass resistance of the first flow pass to the flow path resistance of the second flow pass can differ by changing the pressure within the pressure chamber. Therefore, a micro pump is provided which is capable of transporting minute amounts of fluid in forward and reverse directions with high accuracy using a simple construction.

It is desirable that the first flow pass and the second flow pass of the micro pump respectively have uniform cross sectional configurations taken in a plane that is orthogonal to the flow direction, and that the ratio of the cross sectional area to the flow pass length of the first flow pass is greater than the ratio of the cross sectional area to the flow pass length of the second flow pass.

According to this aspect, the ratio of the flow pass resistance of the first flow pass to the flow pass resistance of the second flow pass can differ when the differential pressure is large and when the differential pressure is small, since the first flow pass and the second flow pass respectively have uniform cross sectional configurations taken in a plane that is orthogonal to the flow direction such that the ratio of the cross sectional area to the flow pass length of the first flow pass is greater than the ratio of the cross sectional area to the flow pass length of the second flow pass.

It is further desirable that the first flow pass of the micro pump has any shape among a shape which rapidly changes cross sectional configurations taken in a plane that is orthogonal to the flow direction, a shape in which the center line is not straight, or a shape having an obstruction in the flow pass.

According to this aspect, the percentage change in the flow pass resistance relative to the change in differential pressure of the first flow pass is greater than that of the second flow pass since the first flow has any shape among a shape which rapidly changes cross sectional configurations taken in a plane that is orthogonal to the flow direction, a shape in which the center line is not straight, or a shape having an obstruction in the flow pass.

It is desirable that the micro pump is provided with drive means for driving the actuator to repeatedly change the volume of the pressure chamber between a first volume and a second volume at specific intervals, and this repetition is such that the time period when increasing the volume of the pressure chamber and the time period when decreasing the volume of the pressure chamber are different.

According to this aspect, the drive means drives the actuator to repeatedly change the volume of the pressure chamber between the volume of the first flow pass and the volume of the second flow pass at specific intervals. Since the time period of increasing the volume of the pressure chamber and the time period of decreasing the volume of the pressure chamber differ in this repetition, the differential pressures of the first flow pass and the second flow pass are different when the volume is increasing and when the volume is decreasing. As a result, the structure of the actuator may be simplified.

It is desirable that the driving means of the micro pump is capable of a first repetition and a second repetition wherein the time periods for increasing the volume of the pressure chamber differ.

According to this aspect, the direction of transport of the fluid in the first repetition is different from that of the second repetition because the time periods for increasing the volume of the pressure chamber are different in the first repetition and the second repetition.

It is desirable that the micro pump is provided with a drive means for driving an actuator to repeatedly change the volume of a pressure chamber between a first volume and a second volume at specific intervals, and the first flow pass has a flow pass resistance in a first direction which is greater than its flow pass resistance in a second direction opposite to the first direction, such that the drive means is capable of driving in a first repetition wherein the time period of increasing the volume is identical to the time period of decreasing the volume, and a second repetition wherein the time period of increasing the volume is different from the time period of decreasing the volume.

According to this aspect, the drive means drives the actuator to repeatedly change the volume of the pressure chamber between the volume of the first flow pass and the volume of the second flow pass at specific intervals. Since the first flow pass has a flow pass resistance in a first direction which is greater than its flow pass resistance in a second direction opposite to the first direction, a fluid is transported in the second direction in the first repetition wherein the time period of increasing the volume is identical to the time period of decreasing the volume, and a fluid is transported in the first direction in the second repetition wherein the time period of increasing the volume differs from the time period of decreasing the volume. Therefore, fluid can be effectively transported in both a forward direction and a reverse direction.

BRIEF DESCRIPTION OF THE DRAWINGS

These and other objects and features of the present invention will become apparent from the following description of the preferred embodiments thereof taken in conjunction with the accompanying drawings.

FIG. 1 is a partial section view of a micro pump of a first embodiment of the present invention.

FIG. 2 is a partial plan view of the micro pump of the first embodiment of the present invention.

In the following description, like parts are designated by like reference numbers throughout the several drawings.

DETAILED DESCRIPTION OF THE PREFERRED EMBODIMENTS

Figure 3B:
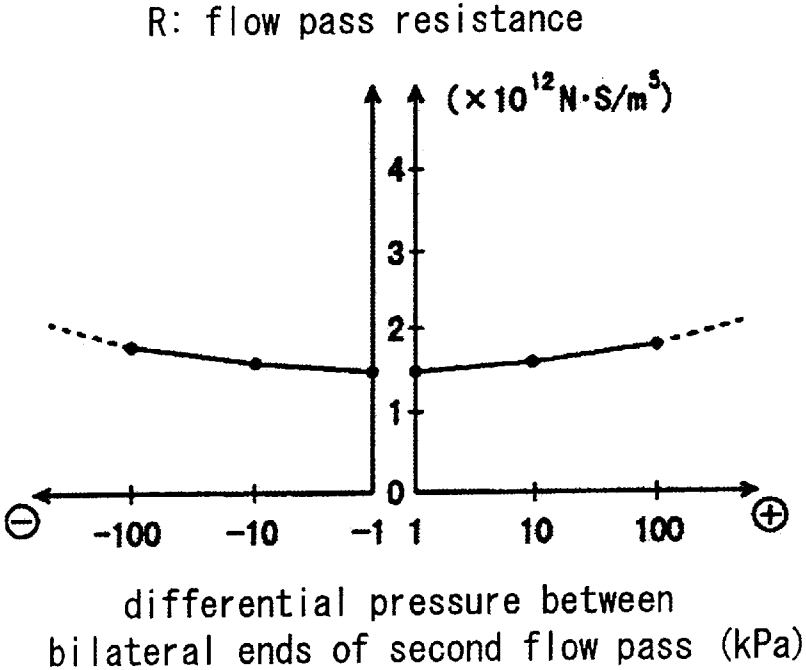
FIG. 3(A) shows the relationship between differential pressure and the flow pass resistance of the first flow pass of the micro pump of the first embodiment and FIG. 3(B) shows the relationship between differential pressure and the flow pass resistance of the second flow pass of the micro pump of the first embodiment.

The preferred embodiments of the present invention are described hereinafter with reference to the accompanying drawings. In the drawings, like reference numbers refer to like or equivalent parts, and descriptions thereof are not repeated.

FIG. 1 is a partial section view of a micro pump of a first embodiment of the present invention. FIG. 2 is a partial plan view of the micro pump of the first embodiment of the present invention. Referring to FIGS. 1 and 2, the micro pump 100 includes a base plate 101 on which is formed a fluid passageway comprising a first fluid chamber 111, a first flow pass 115, a pressure chamber 109, a second flow pass 117, and a second fluid chamber 113 connected in series, and a top plate 103 which is superimposed on the base plate 101; an oscillating plate 105 which is superimposed on the top plate 103; a piezoelectric element 107 which is superimposed on the surface of the oscillating plate 105 on the side thereof which is opposite the side in contact with the pressure chamber 109; and a drive unit 120 for driving the piezoelectric element 107.

The base plate 101 is a photosensitive glass base plate having a thickness of 500 $\mu$m, in which is formed the fluid passageway, comprising first fluid chamber 111, first flow pass 115, pressure chamber 109, second flow pass 117, and second fluid chamber 113, by etching to a depth of 100 $\mu$m. In the first embodiment, the first flow pass 115 has a width of 25 $\mu$m and a length of 20 $\mu$m. The second flow pass 117 has a width of 25 $\mu$m and a length of 150 $\mu$m. Accordingly, the first flow pass 115 and the second flow pass 117 have identical widths and heights, but the length of the second flow pass 117 is longer than the length of the first flow pass 115.

The first flow pass 115 and the second flow pass 117 are not limited to being formed in a slit-like shape by etching the base plate 101, and also may be formed by drilling, punch-pressing, or boring, via laser process or the like, the base plate 101.

The top plate 103 is a glass plate, and is superimposed on the base plate 101 to form the top surface of each of the first fluid chamber 111, first flow pass 115, second fluid chamber 113, and second flow pass 117. A through opening is formed in the top plate 103 at the top surface of the pressure chamber 109, by etching or the like, so that the oscillation plate 105 forms the top surface of the pressure chamber 109.

The oscillation plate 105 is a thin glass plate having a thickness of 50 $\mu$m. The piezoelectric element 107 is a piezoelectric ceramic. In the first embodiment, a lead zirconate-titanate (PZT) ceramic 50 $\mu$m in thickness is used as the piezoelectric element 107. The piezoelectric element 107 and oscillation plate 105 are adhered using an adhesive or the like.

The drive unit 120 generates a voltage of a specific waveform to apply a drive voltage to the piezoelectric element 107. The oscillation plate 105 and the piezoelectric element 107 are subjected to unimorph mode flexing deformation (warping deformation) by applying the drive voltage from the drive unit 120 to the piezoelectric element 107. In this way the volume of the pressure chamber 109 is increased or decreased.

In the micro pump 100 of the first embodiment, when a voltage of 30 V is applied to the piezoelectric element 107, the deformation of the piezoelectric element 107 attains a displacement of 80 nm, and generates a pressure force of 0.4 MPa.

When the capacity of the pressure chamber 109 is changed by the drive of the piezoelectric element 107 as described above, the pressure is temporarily changed in the pressure chamber 109, with the result that a pressure differential is generated by the pressure at the bilateral ends of the first flow pass and a pressure differential is generated by the pressure at the bilateral ends of the second flow pass. Then, the fluid is transported in a direction which eliminates these differential pressures. Accordingly, when the piezoelectric element 107 oscillates at the same magnitude, a large differential pressure can be created in the first flow pass and in the second flow pass depending on the degree of the rapidity of the oscillation (increasing deformation per unit time).

Figure 3A:
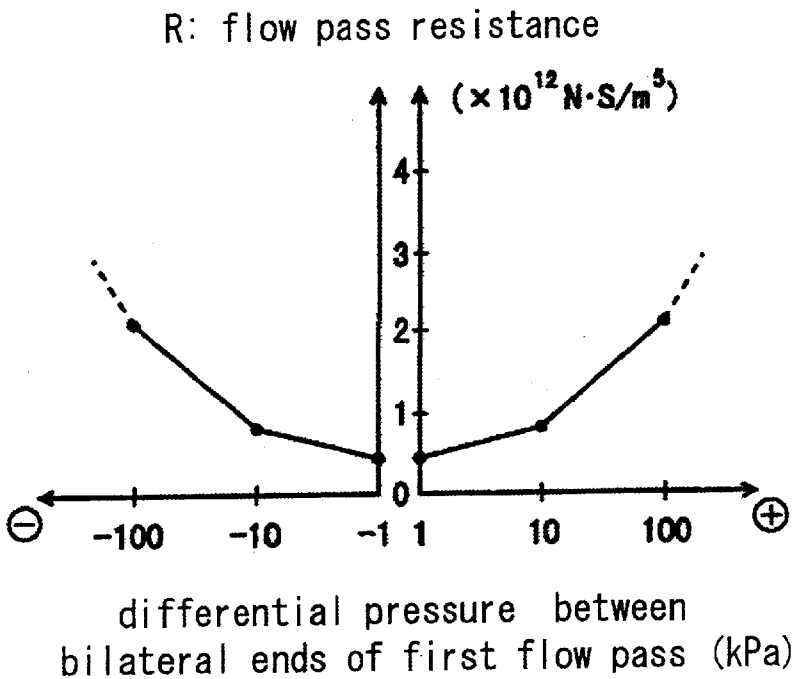

FIG. 3(A) shows the relationship between differential pressure and the flow pass resistance of the first flow pass of the micro pump of the first embodiment, FIG. 3(B) shows the relationship between differential pressure and the flow pass resistance of the second flow pass of the micro pump of the present embodiment. The flow pass resistance corresponds to the pressure loss coefficient when a fluid flows through the flow pass. When the fluid volume flowing per unit time is designated flow Q, and the pressure loss caused by the fluid flowing through the flow pass is designated $\Delta P$, the flow pass resistance R [$N \cdot s/m^5$] is determined by $R=\Delta P/Q$. Furthermore, N is the force (Newtons), and s is time (seconds). The values shown in FIGS. 3(A) and 3(B) are values measured by determining the pressure dependence of the flow pass resistance from the flow speed when a fluid flows at a specific pressure through the first flow pass and the second flow pass, respectively.

Referring to FIGS. 3A and 3B, it can be understood that the second flow pass 117 has a small flow pass resistance pressure dependence, and the first flow pass 115 has a larger flow pass resistance pressure dependence. The following properties are derived from this difference in flow pass resistance pressure dependence. That is, when the differential pressure is large, i.e., when the absolute value of the rate of change of the volume of the pressure chamber per unit time is large, fluid flows with more difficulty in the first flow pass compared to the second flow pass, and when the differential pressure is small, i.e., when the absolute value of the rate of change of the volume of the pressure chamber 109 is small, a fluid flows more freely through the first flow pass compared to the second flow pass. Accordingly, when the absolute value of the rate of change of the volume of the pressure chamber 109 is large, the fluid subjected to the volume change of the pressure chamber 109 mainly flows through the second flow pass 117, and when the volume rate of change of the pressure chamber 109 is small, the fluid subjected to the volume change of the pressure chamber 109 mainly flows through the first flow pass 115.

Figure 4A:
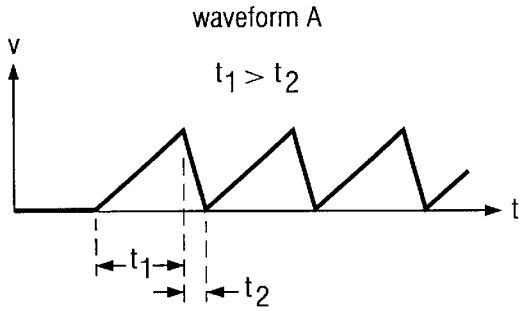
FIG. 4(A) shows a first voltage waveform applied to a piezoelectric element.
Figure 4B:
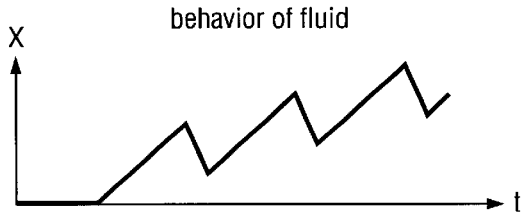
FIG. 4(B) shows the resulting behavior of the fluid.

The waveform of the voltage applied to the piezoelectric element 107 is described below. The voltage applied to the piezoelectric element 107 is generated by the drive unit 120. In the micro pump 100 of the present invention, it is necessary to generate a difference in the absolute value of the pressures when pressurizing and depressurizing the pressure chamber 109. FIG. 4(A) shows a first voltage waveform applied to the piezoelectric element 107 and FIG. 4B shows the resulting behavior of the fluid. When the voltage applied to the piezoelectric element 107 is increased, the piezoelectric element 107 and the oscillation plate 105 are subjected to warping deformation on the pressure chamber 109 side, which results in decreasing the volume of the pressure chamber 109. Conversely, when the voltage applied to the piezoelectric element 107 is reduced, the volume of the pressure chamber 109 is increased due to the lesser amount of displacement of the warping deformation of the piezoelectric element 107. Referring to FIG. 4(A), the waveform of the voltage applied to the piezoelectric element 107 is such that the rise time period t1 is longer than the fall time period t2. Accordingly, when a voltage having the waveform shown in FIG. 4(A) is applied to the piezoelectric element 107, the absolute value of the rate of volume change per unit time of the pressure chamber 109 is smaller during time period t1 than during time period t2. Therefore, the first flow pass 115 allows easier fluid flow during time period t1 than during time period t2, and the second flow pass 117 has virtually unchanged fluid flow during time period t1 and time period t2.

In FIG. 4(B), time is plotted on the horizontal axis, and fluid location is plotted on the vertical axis. The fluid location is shown with the forward direction on the right side in FIG. 1. As understood from FIG. 4(B), for the previously described reasons, the macro fluid flow is in the forward direction, i.e., flows in a direction from the left side toward the right side in FIG. 1.

Figure 5A:
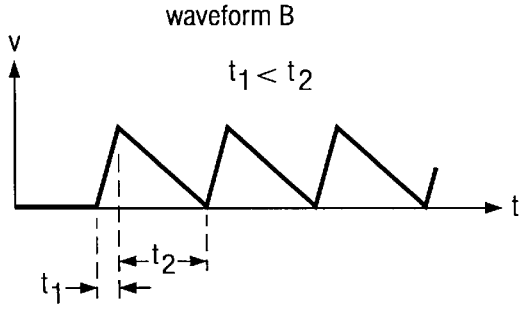
FIG. 5(A) shows a second voltage waveform applied to a piezoelectric element.
Figure 5B:
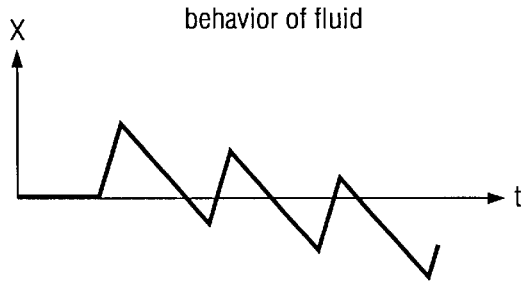
FIG. 5(B) shows the resulting behavior of the fluid.

FIG. 5(A) shows a second voltage waveform applied to the piezoelectric element 107, and FIG. 5(B) shows the resulting behavior of the fluid. Referring to FIG. 5(A), the voltage waveform applied to the piezoelectric element 107 has a rise time period t1 that is shorter than the fall time period t2. Accordingly, when a voltage having the waveform shown in FIG. 5(A) is applied to the piezoelectric element 107, the absolute value of the volume change rate per unit time of the pressure chamber 109 is greater during time period t1 than during time period t2. Therefore, the first flow pass 115 allows easier fluid flow during time period t1 than during time period t2, and the second flow pass 117 has virtually unchanged fluid flow at time period t1 and time period t2.

In FIG. 5(B), time is plotted on the horizontal axis, and fluid location is plotted on the vertical axis. The fluid location is shown with the forward direction on the right side in FIG. 1. As understood from FIG. 5(B), for the previously described reasons, the macro fluid flow is in the reverse direction, i.e., flows in a direction from the right side toward the left side in FIG. 1.

The macro flow of the fluid can be expressed by the fluid transport efficiency. The fluid transport efficiency is determined by the ratio of the first flow pass 115 flow pass resistance to the second flow pass 117 flow pass resistance at a high differential pressure, and the ratio of the first flow pass 115 flow pass resistance to the second flow pass 117 flow pass resistance at a low differential pressure. When the ratio of the first flow pass 115 flow pass resistance relative to the second flow pass 117 flow pass resistance at a low differential pressure is designated Kl, and the ratio of the first flow pass 115 flow pass resistance relative to the second flow pass 117 flow pass resistance at a high differential pressure is designated Kh, the fluid transport efficiency a can be expressed by equation (1) below.

$$\alpha=(1/(1+Kl))-(1/(1+Kh)) \quad (1)$$

In the micro pump 100 of the first embodiment, the differential pressure at low pressure is 10 kPa, and the differential pressure at high pressure is 100 kPa. At this time, the flow pass resistance ratio at low pressure Kl is nearly equal to 0.56, and the flow pass resistance Kh at high pressure is nearly equal to 1.17. When these values are substituted in eq. (1), the fluid transport efficiency $\alpha$ is approximately 18% in both the forward direction and the reverse direction.

It can be understood from eq. (1) that in order to improve the fluid transport efficiency $\alpha$ it is desirable that Kl is made as small as possible, and Kh is made as large as possible. For this reason one flow pass has a variable flow pass resistance via differential pressure which is as small as possible (laminar behavior), and the other flow pass has a variable flow pass resistance via differential pressure which is as large as possible (turbulent behavior). It is further desirable that the small and large relationships between the values of the flow pass resistance of the first flow pass and the second flow pass at low pressure and high pressure are reversed.

The region of changing differential pressure is desirably shifted entirely to the high pressure direction to improve fluid transport efficiency. Specifically, a pressure of 10 kPa at low pressure and a pressure of 100 kPa at high pressure is more advantageous than having a pressure of 1 kPa at low pressure and a pressure of 10 kPa at high pressure.

DRIVE VOLTAGE MODIFICATIONS

Most typically the waveforms shown in FIGS. 4(A) and. 5(A) are used to differentiate the time required to raise the voltage applied to the piezoelectric element 107 and the time required for voltage fall. The waveform is not limited to these examples insofar as the waveform is not symmetrical for rise and fall on the time axis.

Figure 6A:
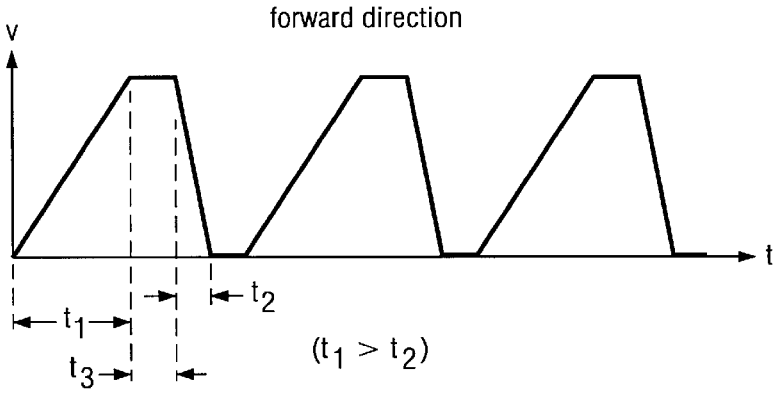
FIGS. 6(A) and 6(B) show modifications of the first and second waveforms of voltages applied to the piezoelectric element from the drive unit 120 of the micro pump of the first embodiment.
Figure 6B:
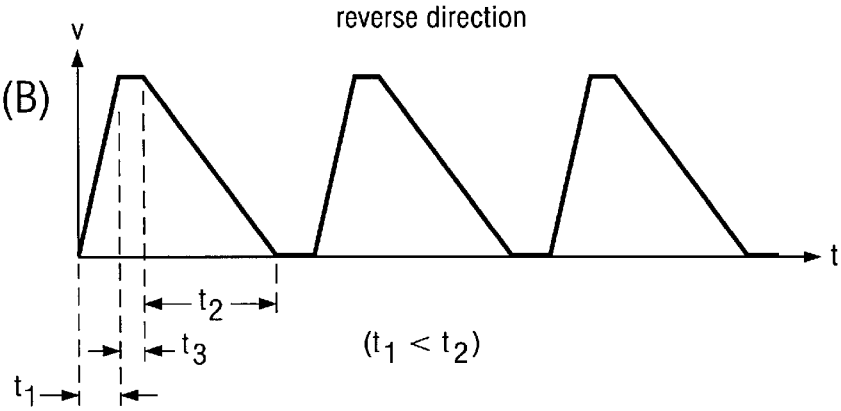

FIGS. 6(A) and 6(B) show a modification of the waveforms of the voltages applied to the piezoelectric element 107 by the drive unit 120 of the micro pump of the first embodiment. Specifically, FIG. 6(A) shows a waveform for transporting the fluid in the forward direction, and FIG. 6(B) shows a waveform for transporting the fluid in the reverse direction. In this example, a time period t3 during which the voltage does not change is included between the time period t1 and the time period t2.

When the fluid is transported in the forward direction, the time period t1 is longer than the time period t2, and when the fluid is transported in the reverse direction, the time period t1 is shorter than the time period t2. Other than the addition of a time period t3, during which the voltage does not change, inserted between the time period t1 and the time period t2, the waveforms are identical to those shown in FIGS. 4(A) and 5(A). Since the voltage does not change in time period t3, the volume of the pressure chamber 109 does not change, and the differential pressure of the first flow pass 115 and the second flow pass 117 is zero. Therefore, the fluid can be transported in the forward direction or the reverse direction by applying a voltage of the waveform shown in FIG. 6(A) or FIG. 6(B), respectively, to the piezoelectric element 107.

The reason for providing the time period t3 is to mitigate the influence of oscillation of the piezoelectric element 107 due to inertia after voltage application. That is, directly after the voltage value peaks, the force acting on the piezoelectric element 107 increases so as to cause deformation due to inertia, and a force acts to restore the element 107 to its original state by a restorative force due to elasticity, such that unnecessary oscillation is generated. While this oscillation remains there is a possibility that a desired deformation will not be obtained due to the influence of the oscillation when the voltage falls. In this case, a time period t3 is provided during which the voltage does not change after the voltage value peaks, so as to await the reduction of this unnecessary oscillation and suppress its influence to a minimum level.

The shapes of the first flow pass 115 and the second flow pass 117 are described below. The second flow pass 117 requires a shape which generates a flow attaining the boundary layer of laminar flow. For this reason it is desirable that the Reynolds number Re is low, and the ratio of the flow pass length to the flow pass width is large. The Reynolds number Re is a general index value used in fluid dynamics. As the Reynolds number increases it represents a value approaching the turbulent flow range. The Reynolds number can be expressed as $Re=\rho vd/\eta$ when the fluid density is designated $\rho$, the fluid coefficient of viscosity is designated $\eta$, the flow speed is designated v, and the length of one edge, when the flow pass has a rectangular cross sectional configuration, taken in a plane that is orthogonal to the flow direction, is designated d.

Although the Reynolds number differs depending on the cross sectional configurations taken in a plane that is orthogonal to the flow direction, the theory of an annular flow pass is well known. That is, in an annulus of diameter d and length L, it is desirable that $L>k\times Re\times d$ in laminar flow ($Re<2320$). The constant k is k=0.065 as determined by Nikuradse's test, and k=0.058 as determined by Langharr's test.

Basically, a flow pass having a long length and a uniform cross sectional configuration taken in a plane that is orthogonal to the flow direction is desirable, but the shape is not limited to this shape insofar as the shape produces a flow which attains the boundary layer. Even when there is insufficient boundary layer attainment, it is desirable that the laminar flow have a high degree of boundary layer attainment compared to the first flow pass 115.

On the other hand, the first flow pass 115 requires a shape producing turbulent flow or vortex, or a shape including a range of insufficient formation of the boundary layer. The first flow pass 115 has a shape which increases the value of the flow pass resistance as the differential pressure increases, and an example of such a shape is shown below. The differential pressure is the difference in pressure at the bilateral ends of the flow pass.

Parameters of the shape of the first flow pass 115 are described below.

(1) High Reynolds Number Re

Although the optimum value depends on shape, an annular shape requires Re>2320 at least at peak flow speed (turbulent flow).

(2) Shapes Having a Relatively Small Flow Pass Length L Relative to Flow Pass Diameter d Although suitable values differ depending on shape, an annular shape requires $L<0.065\times Re\times d$ at least at peak flow speed.

Figure 7:
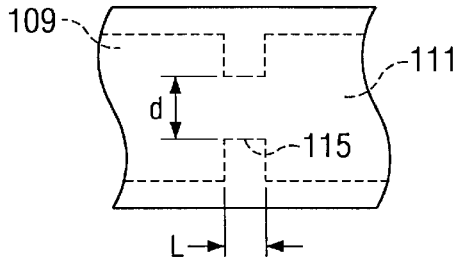
FIG. 7 shows a first example of a shape of the first flow pass of the micro pump of the present invention.

FIG. 7 shows a first example of a shape of the flow pass 115. Referring to FIG. 7, when the first flow pass 115 has a square cross sectional configuration taken in a plane that is orthogonal to the flow direction, the length of one edge is designated d, and the length of the first flow pass 115 is designated L, the condition is that the ratio L/d is relatively small. When the first flow pass 115 has a circular cross sectional configuration taken in a plane that is orthogonal to the flow direction, the diameter is designated d, and the flow pass length is designated L, the condition is that the flow pass length and the ratio L/d are small. In particular, the condition is that $L/d<0.065\times Re$ at peak flow speed (condition (2)).

Figure 8:
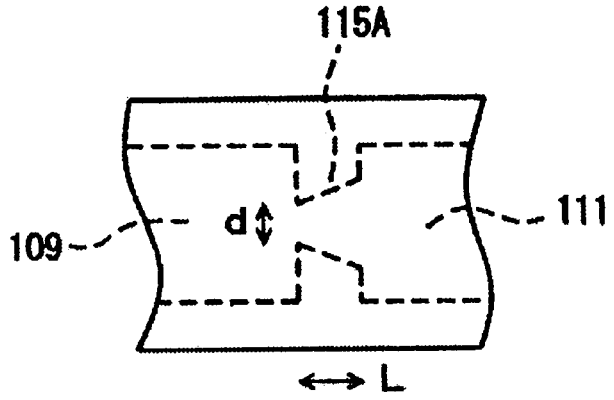
FIG. 8 shows a second example of a shape of the first flow pass of the micro pump of the present invention.

FIG. 8 shows a second example of a shape of the first flow pass. Referring to FIG. 8, a first flow pass 115A has a shape wherein the width gradually becomes larger from the pressure chamber 109 toward the first fluid chamber 111. In this instance, also, the shape of the first flow pass 115A satisfies condition (2).

Figure 9:
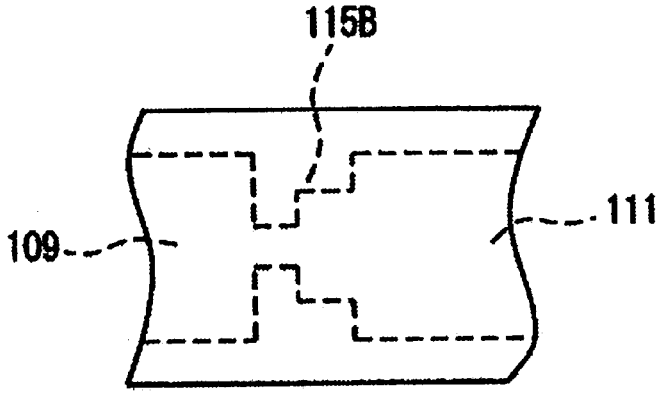
FIG. 9 shows a third example of a shape of the first flow pass of the micro pump of the present invention.

FIG. 9 shows a third example of a shape of the first flow pass. Referring to FIG. 9, the first flow pass 115B has a shape wherein the cross sectional area taken in planes that are orthogonal to the flow direction changes in two stages, and the change in area is abrupt. The cross sectional configurations taken in a plane that is orthogonal to the flow direction of the first flow pass 115B may be circular or rectangular. Even examples other than those of FIGS. 8 and 9 may be suitable by satisfying the conditions by a shape which changes the cross section perpendicular to the direction of fluid flow from one end to the other end of the first flow pass.

Figure 10:
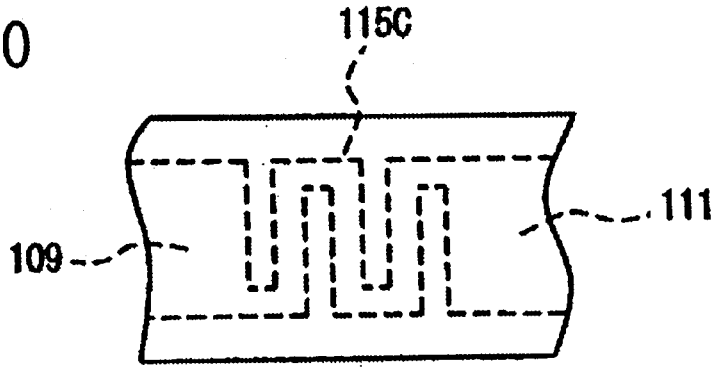
FIG. 10 shows a fourth example of a shape of the first flow pass of the micro pump of the present invention.

FIG. 10 shows a fourth example of a shape of the first flow pass. The first flow pass 115C is disposed between the pressure chamber 109 and the first fluid chamber 111, and the fluid flow direction is not a straight line but rather is bent.

Figure 11:
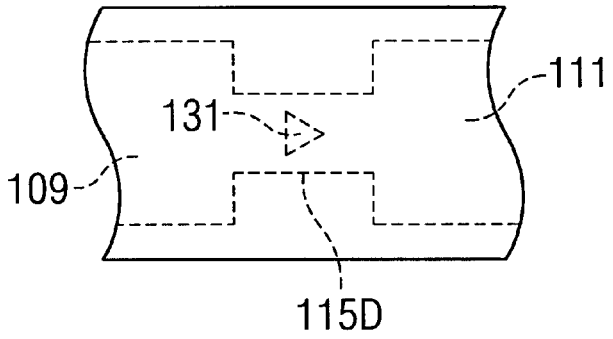
FIG. 11 shows a fifth example of a shape of the first flow pass of the micro pump of the present invention.

FIG. 11 shows a fifth example of a shape of the first flow pass. The first flow pass 115D is provided with an obstruction 131 in the approximate center of the first flow pass. The cross section shape of the obstruction 131 perpendicular to the fluid flow direction becomes smaller from the pressure chamber 109 toward the first fluid chamber 111.

Figure 12:
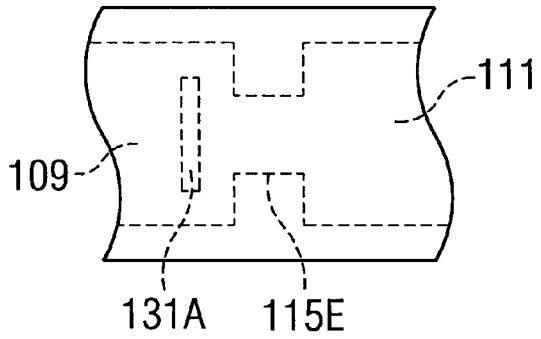
FIG. 12 shows a sixth example of a shape of the first flow pass of the micro pump of the present invention.

FIG. 12 shows a sixth example of a shape of the first flow pass. Referring to FIG. 12 an obstruction 131A is disposed in pressure chamber 109 near the first flow pass 115E.

Figure 13:
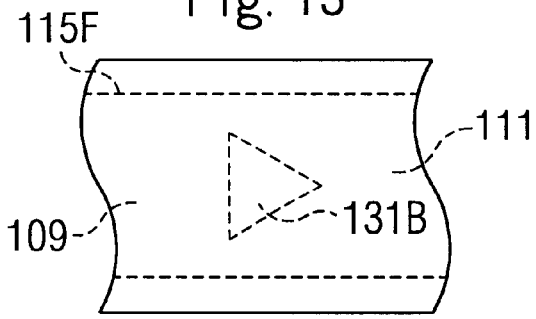
FIG. 13 shows a seventh example of a shape of the first flow pass of the micro pump of the present invention.

FIG. 13 shows a seventh example of a shape of the first flow pass. Referring to FIG. 13, the first flow pass 115F has the same width as the pressure chamber 109 and the first fluid chamber 11, and connects the pressure chamber 109 and the first fluid chamber 111. An obstruction 131B is provided in the first flow pass 115F between the pressure chamber 109 and the first fluid chamber 111. The obstruction 131B has a cross section which becomes smaller from the pressure chamber 109 toward the first fluid chamber 111. Since an obstruction 131B is provided in the first flow pass 115F, the area through which a fluid can pass in the first flow pass 115 is smaller than the cross sectional area of the pressure chamber 109 and the cross sectional area of the first fluid chamber 111.

SECOND EMBODIMENT OF THE MICRO PUMP

A modification of the micro pump is described below. The modified micro pump provides directionality in the first flow pass. Directionality is the difference in the flow resistance when fluid flows from the pressure chamber 109 to the first fluid chamber 111 and the flow resistance when the fluid flows from the first fluid chamber 111 to the pressure chamber 109 under condition of the same absolute value of differential pressure. In this way by providing directionality in the first flow pass, fluid can be transported in a single direction even when a sine wave voltage is applied to the piezoelectric element 107 by the drive unit 120. Generally, when a fluid is transported unidirectional, it is most effective to apply a sine wave voltage to the piezoelectric element 107 so as to vibrate the oscillation plate 105 at the resonance point. Accordingly, fluid can be transported in a direction in accordance with the directionality of the first flow pass by providing directionality in the first flow pass and applying a sine voltage to the piezoelectric element 107. In this instance, a fluid can be efficiently transported since a sine wave voltage is applied to the piezoelectric element 107 to vibrate the oscillation plate 105 at the resonance point.

On the other hand, a fluid can be transported in a direction opposite the direction in accordance with the directionality of the first flow pass by applying voltages having different time period required for voltage rise and time period required for voltage fall to the piezoelectric element 107 for the same reason as described in the embodiment of FIG. 2. In this way a micro pump is provided wherein fluid transport is achieved efficiently in a direction in accordance with the directionality of the first flow pass, and fluid transport is achieved in a direction opposite the direction in accordance with the directionality of the first flow pass 115.

Figure 14:
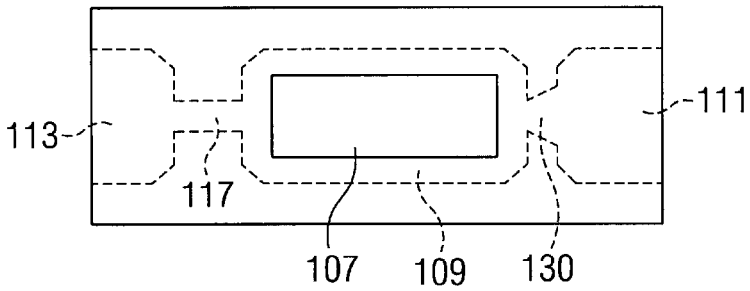
FIG. 14 is a plan view of a first modification of the micro pump of the present invention.

FIG. 14 is a plan view of a second embodiment of the micro pump of the present invention. Referring to FIG. 14, the micro pump 100 of the second embodiment is provided with a first flow pass 130 wherein the width increases from the pressure chamber 109 toward the first fluid chamber 111. For this reason the flow resistance when fluid flows from the pressure chamber 109 to the first fluid chamber 111 is smaller than the flow resistance when fluid flows from the first fluid chamber 111 to the pressure chamber 109. As a result, when the time period of pressurization and the time period of depressurization of the pressure chamber 109 are identical, there is a macro fluid flow from the second fluid chamber 113 through the pressure chamber 109 to the first fluid chamber 111.

Furthermore, if the time period of pressurization of the pressure chamber 109 is less than the time period of depressurization, macro fluid flow is from the first fluid chamber 111 through the pressure chamber 109 to the second fluid chamber 113 in the same way as the first embodiment shown in FIG. 2.

Figure 15A:
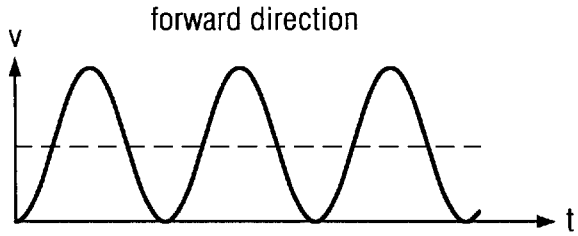
FIGS. 15(A) and 15(B) show an example of waveforms of voltages applied to the piezoelectric element from the drive unit in the second embodiment of the micro pump of the present invention.
Figure 15B:
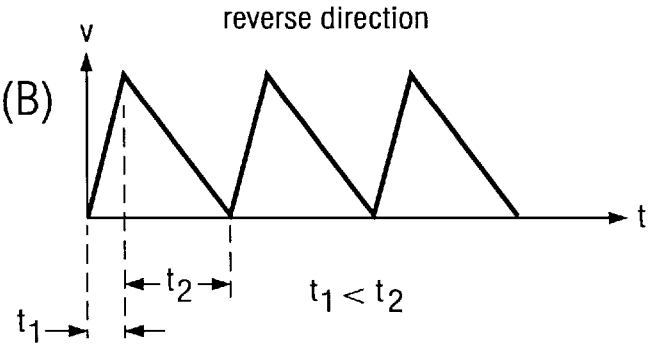

FIGS. 15(A) and 15(B) show an example of voltages applied to the piezoelectric element 107 by the drive unit 120 of the second embodiment of the micro pump 100 of the present invention. Specifically, FIG. 15(A) shows the voltage waveform for transporting fluid from the pressure chamber 109 to the first fluid chamber 111, and FIG. 15(B) shows the voltage waveform for transporting the fluid from the first fluid chamber 111 to the pressure chamber 109. The waveform shown in FIG. 15(A) is a sine wave. This sine wave is the waveform of the voltage applied to the piezoelectric element 107 to vibrate the oscillation plate 105 at the resonance point. As a result, when this sine wave voltage is applied to the piezoelectric element 107, there is a macro fluid flow in the direction in accordance with the directionality of the first flow pass 130, i.e., fluid flows from the first fluid chamber 111 toward the pressure chamber 109.

The waveform shown in FIG. 15(B) shows that the time period t1 of voltage increase is shorter than the time period t2 of voltage decrease. For this reason the time period of decreasing volume of the pressure chamber 109 is shorter than the time period of increasing volume. As a result, the differential pressure of the first flow pass 130, when the volume of the pressure chamber 109 is decreasing, is greater than the differential pressure of the first flow pass 130 when the volume of the pressure chamber 109 is increasing. This results in the fluid flowing more readily in the first flow pass 130 in time period t2 than in time period t1, whereas the ease of flow is virtually unchanged in time period t1 or time period t2 in the second flow pass 117. Accordingly, when a voltage of this waveform is applied to the piezoelectric element 107, macro fluid flow is in a direction opposite the direction of directionality of the first flow pass 130, i.e., fluid flows from the first fluid chamber 111 toward the pressure chamber 109.

Figure 16A:
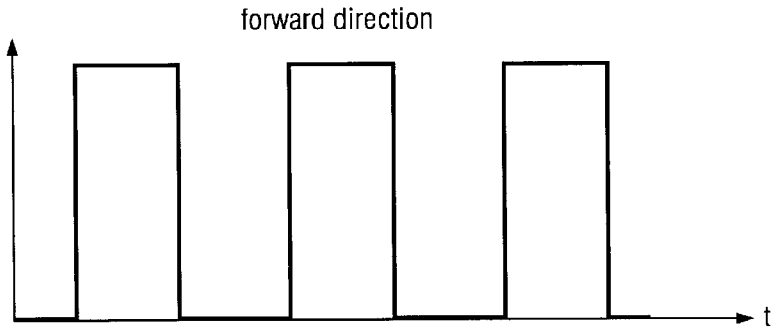
FIGS. 16(A) and 16(B) show another example of the waveforms of the voltages applied to the piezoelectric element from the drive unit in the second embodiment of the micro pump of the present invention.
Figure 16B:
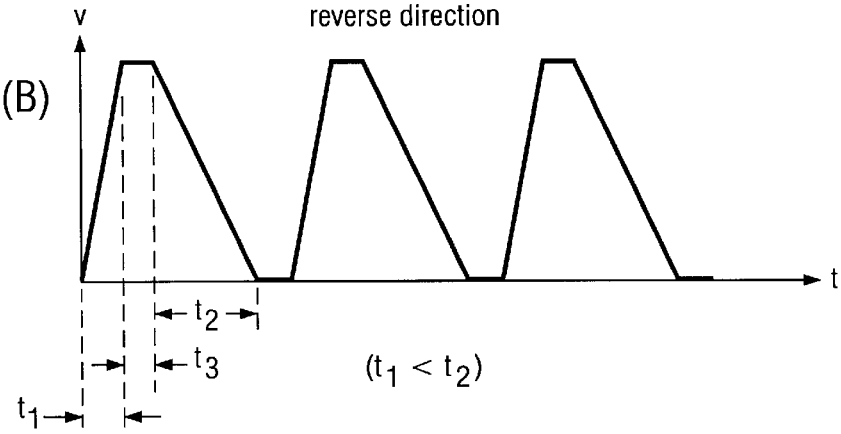

FIGS. 16(A) and 16(B) show another example of the waveforms of the voltages applied to the piezoelectric element 107 by the drive unit 120 in the second embodiment of the micro pump 100 of the present invention. FIG. 16(A) shows the voltage waveform for transporting the fluid from the pressure chamber 109 toward the first fluid chamber 111, and FIG. 16(B) shows the voltage waveform for transporting the liquid from the first fluid chamber 111 toward the pressure chamber 109. Referring to FIG. 16(A), the waveform of the voltage is rectangular. The time period of increasing volume of the pressure chamber 109 and the time period of decreasing volume are identical. In the first flow pass 130, the absolute value of the differential pressures of the flow pass 130 are identical when increasing and decreasing the volume of the pressure chamber 109. Therefore, fluid flows in the direction in accordance with the directionality of the first flow pass 130, i.e., fluid flows from the pressure chamber 109 toward the first fluid chamber 111.

Referring to FIG. 16(B), the time period t1 of increasing voltage is shorter than the time period t2 of decreasing voltage. Furthermore, a time period t3 wherein the voltage does not change is included between the time period t1 and the time period t2. Since the time period t1 of increasing voltage is shorter than the time period t2 of decreasing voltage, the time period t1 of decreasing volume of the pressure chamber 109 is shorter than the time period t2 of increasing volume. As a result, the absolute value of the differential pressure of the first flow pass during time period t1 is greater than the absolute value of the differential pressure of the first flow pass 130 during time period t2. Therefore, fluid flows in the direction opposite the directionality of the first flow pass 130, i.e., fluid flows from the pressure chamber 109 toward the second fluid chamber 113.

THIRD EMBODIMENT OF THE MICRO PUMP

Figure 17:
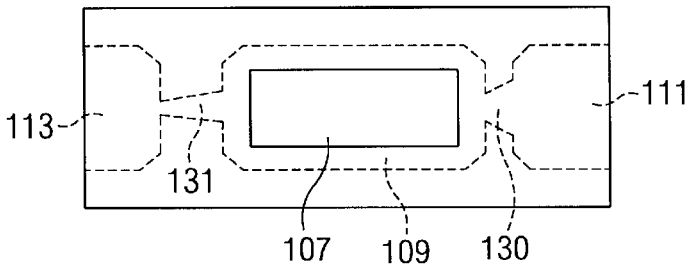
FIG. 17 is a plan view of a third embodiment of the micro pump of the present invention.

FIG. 17 is a plan view of a third embodiment of the micro pump 100 of the present invention. If the first flow pass and the second flow pass are compared relatively and the difference in rate of change of the flow pass resistance relative to differential pressure is recognized, the second flow pass also may be provided directionality in addition to the first flow pass without problem. The condition is that the rate of change of the flow pass resistance relative to differential pressure in the first flow pass is greater than the rate of change of the flow pass resistance in the second flow pass. The efficiency of transporting fluid when a sine wave voltage is applied to the piezoelectric element 107 can be improved by providing both the first flow pass and the second flow pass with identical directionalities.

Referring to FIG. 17, the second flow pass 131 has a shape wherein the width increases from the second fluid chamber 113 toward the pressure chamber 109. Therefore, the flow pass resistance when fluid flows from the second fluid chamber 113 toward the pressure chamber 109 is less than the flow pass resistance when the fluid flows from the pressure chamber 109 toward the second fluid chamber 113. If the time period of decreasing volume and the time period of increasing volume of the pressure chamber 109 are identical, the macro fluid flow is in a direction in accordance with the directionality of the first flow pass 130 and the second flow pass 131, i.e., the fluid flows from the second fluid chamber 113 toward the pressure chamber 109.

On the other hand, if the time period of decreasing volume of the pressure chamber 109 is shorter than the time period of increasing volume, the macro fluid flow is in a direction opposite the directionality of the first flow pass 130 and the second flow pass 131, i.e., fluid flows from the first fluid chamber 111 toward the pressure chamber 109.

Figure 18B:
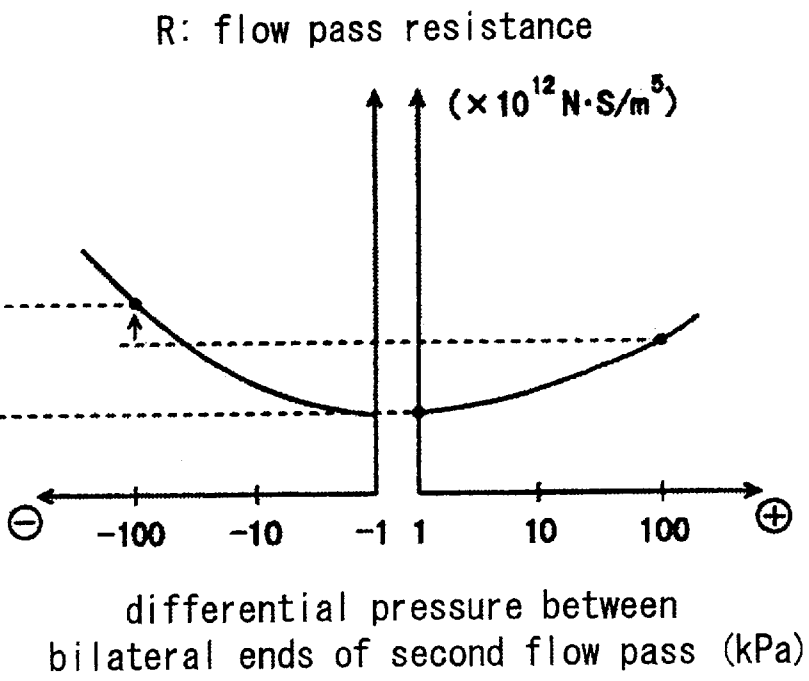
FIG. 18(B) shows the relationship between the differential pressure and the second flow pass of the third embodiment of the micro pump of the present invention.
Figure 18A:
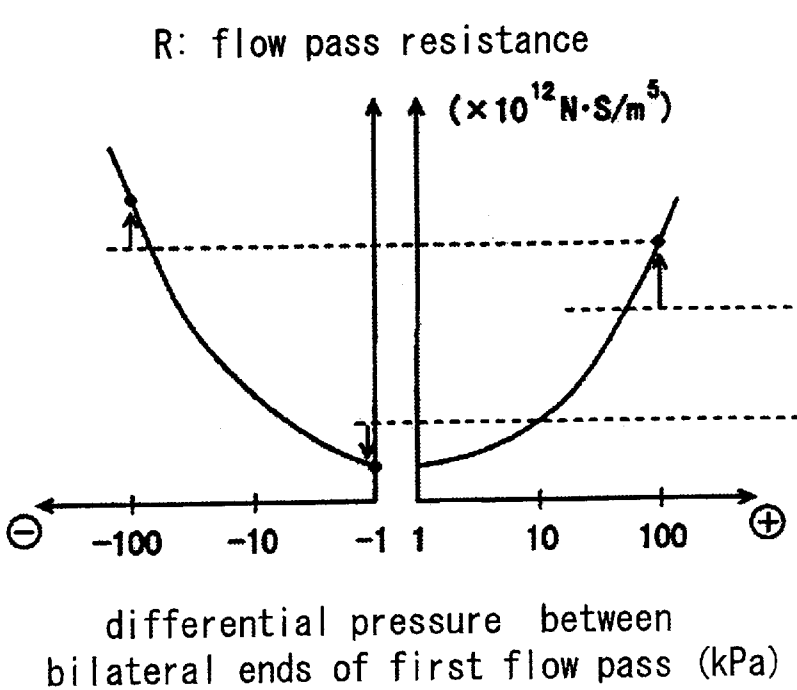
FIG. 18(A) shows the relationship between the differential pressure and the flow pass resistance of the first flow pass of the third embodiment of the micro pump of the present invention.

FIGS. 18(A) and 18(B) show the relationship between the differential pressure and the flow pass resistance of the first flow pass 130 and the second flow pass 131 of the third embodiment of the micro pump 100 of the present invention embodiment. FIG. 18(A) shows the case of the first flow pass 130, and FIG. 18(B) shows the case of the second flow pass 131. Referring to these figures, the flow pass resistance when the differential pressure is positive for both the first flow pass and the second flow pass is less than the flow pass resistance when the differential pressure is negative. Accordingly, each of the first flow pass and the second flow pass has directionality. Furthermore, the percentage change in the flow pass resistance relative to the change in differential pressure of the first flow pass is greater than the percentage change in the flow pass resistance relative to the differential pressure of the second flow pass. Therefore, fluid can flow can be transported in a direction opposite to the fluid flow direction when the time period of increase and the time period of decrease are identical by having the time period of decreasing volume of the pressure chamber shorter than the time period of increasing volume.

The micro pump of the third embodiment described above generates turbulent flow only in the first flow pass 130 and the second flow pass 131 when fluid flow is steep. Therefore, the direction of macro fluid flow is controlled by switching between voltages of two waveforms to drive the piezoelectric element 107, so as to transport the fluid in a standard direction and an opposite direction.

A stable drive micro pump is realized which has improved responsiveness and durability compared to a method which operates a check valve. In addition, the structure of the micro pump is simple, and the micro pump itself is compact.

Fluid is transported with high precision and without pulsation since only a small amount of fluid is transported per single pulse signal of the voltage driving the piezoelectric element 107.

The micro pump 100 of the illustrated embodiments uses the unimorph oscillation of the adhered piezoelectric element 107 and the oscillation plate 105 functioning as an actuator, but the present invention is not limited to unimorph oscillation insofar as the increase and decrease in volume of the pressure chamber 109 can be repeated. For example, a diaphragm may be oscillated using horizontal oscillation or vertical oscillation of a piezoelectric element, shearing deformation of the piezoelectric element may be used, or a micro tube using piezoelectric material may be reduced in the diameter direction. Shearing deformation of the piezoelectric element is also referred to as shear mode deformation, and is a deformation caused by shearing an element obliquely when the bifurcation direction of the piezoelectric element intersects the electric field direction. Alternatives to a piezoelectric element include methods which deform a diaphragm using electrostatic force, and methods using shape-memory alloy on part of the oscillation element.

Although the present invention has been fully described by way of examples with reference to the accompanying drawings, it is to be noted that various changes and modification will be apparent to those skilled in the art. Therefore, unless otherwise such changes and modifications depart from the scope of the present invention, they should be construed as being included therein.

What is claimed is:

1. A micro pump comprising:

a first area including a first flow pass, said first area having a variable flow pass resistance in accordance with a difference in pressure between bilateral ends of the first flow pass area, a second area including a second flow pass, said second area having a variable flow pass resistance is changed in accordance with a difference in pressure between bilateral ends of the second area, wherein a percentage change in the flow pass resistance of the second area in accordance with the difference in pressure between the bilateral ends of the second area is smaller than a percentage change in the flow pass resistance of the first in accordance with the difference in pressure between the bilateral ends of the first area;

a pressure chamber connecting the first flow pass to the second flow pass;

an actuator for changing a pressure force within the pressure chamber; and a driver for selectively applying to said actuator voltage signals having a first waveform and a second waveform, wherein the voltage signals of the first waveform are for transporting fluid in the pressure chamber toward the first flow pass and the voltage signals of the second waveform are for transporting fluid in the pressure chamber toward the second flow pass.

2. A micro pump according to claim 1, wherein the actuator changes the pressure force within the pressure chamber by changing a volume of the pressure chamber.

3. A micro pump according to claim 1, wherein the first flow pass has uniform cross sectional configurations taken in planes that are orthogonal to flow directions, through the first flow pass, wherein the second flow pass has uniform cross sectional configurations taken in planes that are orthogonal to flow directions through the second flow pass, and wherein the ratio of the cross sectional area of the first flow pass relative to a flow pass length of the first flow pass is greater than the ratio of the cross sectional area of the second flow pass relative to a flow pass length of the second flow pass.

4. A micro pump according to claim 1, wherein the first flow pass has a first cross sectional configuration taken in a first plane that is orthogonal to a flow direction through the first flow pass and has a second cross sectional configuration taken in a second plane that is parallel to the first plane and taken at a different position than that of the first plane with respect to the flow direction through the first flow pass, and wherein a shape of the first cross sectional configuration is different from a shape of the second sectional configuration.

5. A micro pump according to claim 1, wherein the first flow pass has a shape of which a center line thereof is not straight.

6. A micro pump according to claim 1, wherein the first flow pass has an obstruction therein.

7. A micro pump according to claim 1, wherein each of the first flow pass and the second flow pass has a tapered shape, wherein aspect ratios of the tapered shapes are different from each other.

8. A micro pump according to claim 1, wherein the actuator comprises a piezoelectric element.

9. A micro pump according to claim 1, wherein the driver drives the actuator to repeatedly change a volume of the pressure chamber between a first volume and a second volume at specific intervals, wherein at least one of the first and second waveforms has a first time period required to change the volume of the pressure chamber from the first volume to the second volume and a second time period required to change the volume of the pressure chamber from the second volume to the first volume, and wherein the first time period and second time period are different from each other.

10. A micro pump according to claim 9, wherein the at least one of the first and second waveform has a third time period, during which an amplitude of the voltage signal is not changed, between the first time period and the second time period.

11. A micro pump according to claim 1, wherein the driver drives the actuator to repeatedly change a volume of the pressure chamber between a first volume and a second volume at specific intervals, and wherein a time period of the first waveform required to change the volume of the pressure chamber from the first volume to the second volume is different from a time period of the second waveform required to change the volume of the pressure chamber from the first volume to the second volume for the purpose of changing direction of transport of the fluid.

12. A micro pump according to claim 9, wherein the actuator comprises a piezoelectric element.

13. A micro pump according to claim 1, wherein the driver drives the actuator to repeatedly change a volume of the pressure chamber between a first volume and a second volume at specific intervals, wherein the first area has a first flow pass resistance characteristic when the fluid flows in a first direction and a second flow pass resistance characteristic when the fluid flows in a second direction opposite to the first direction, the first flow pass resistance characteristic having a pressure dependency greater than that of the second flow pass resistance characteristic, wherein, in the first waveform, a time period for increasing the volume of the pressure chamber is identical to a time period for decreasing the volume, and wherein, in the second waveform, a time period for increasing the volume of the pressure chamber is different from a time period for decreasing the volume.

14. A micro pump according to claim 13, wherein the actuator comprises a piezoelectric element.

15. A micro pump comprising:

a pressure chamber for accommodating a fluid;

an actuator which is capable of repeatedly increasing and decreasing an internal pressure of the pressure chamber, in accordance with at least one of a first prescribed manner and a second prescribed manner, a first flow pass connected with the pressure chamber, wherein the fluid is capable of flowing through the first flow pass to or from the pressure chamber, and a second flow pass connected with the pressure chamber, wherein the fluid is capable of flowing through the second flow pass to or from the pressure chamber, wherein, under the first prescribed manner, a first area including the first flow pass has a first flow pass resistance when the internal pressure is increased and a second flow pass resistance when the internal pressure is decreased, while a second area including the second flow pass has a third flow pass resistance that is greater than the first flow pass resistance when the internal pressure is increased and a fourth flow pass resistance that is smaller than the second flow pass resistance when the internal pressure is decreased, wherein, under the second prescribed manner, the first area has a fifth flow pass resistance when the internal pressure is increased and a sixth flow pass resistance when the internal pressure is decreased, while the second area has a seventh flow pass resistance that is smaller than the fifth flow pass resistance when the internal pressure is increased and an eighth flow pass resistance that is greater than the sixth flow pass resistance when the internal pressure is decreased.

16. A micro pump according to claim 15, further comprising:

a driver, connected with the actuator, being capable of sequentially applying to the actuator voltage signals of a first waveform so that the actuator repeatedly increases and decreases the internal pressure of the pressure chamber in accordance with the first prescribed manner.

17. A micro pump according to claim 16, wherein the first waveform comprises a rising time period during which an amplitude of the voltage signal is increased and a falling time period during which the amplitude of the voltage signal is decreased.

18. A micro pump according to claim 17, wherein the rising time period and the falling time period respectively require a first time period length and a second time length.

19. A micro pump according to claim 18, wherein the first time length is different from the second time length.

20. A micro pump according to claim 18, wherein the first waveform further comprises, between the rising time period and the falling time period, a keeping time period during which an amplitude of the voltage signal is maintained.

21. A micro pump according to claim 18, wherein the first time length and the second time length are identical.

22. A micro pump according to claim 21, wherein the first waveform has a shape of a sine wave.

23. A micro pump according to claim 16, wherein the driver is further capable of sequentially applying to the actuator second voltage signals of a second waveform that is different from the first waveform so that the actuator repeatedly increases and decreases the internal pressure of the pressure chamber in accordance with the second prescribed manner.

24. A micro pump according to claim 15, wherein a cross sectional configuration of the first flow pass is identical to a cross sectional configuration of the second flow pass, and wherein a length of the first flow pass is different from a length of the second flow pass.

25. A micro pump according to claim 15, wherein a shape of the first flow pass is different from a shape of the second flow pass.

26. A micro pump according to claim 25, wherein at least one of the first flow pass and the second flow pass has a tapered shape.

27. A micro pump according to claim 25, wherein at least one of the first flow pass and the second flow pass has a cross sectional configuration which changes in a stepwise manner.

28. A micro pump according to claim 25, wherein at least one of the first flow pass and the second pass has an obstruction therein.

29. A micro pump according to claim 15, wherein the actuator comprises a piezoelectric element.

30. A micro pump according to claim 29, wherein the actuator further comprises:

an oscillating plate to which the piezoelectric element is disposed.

31. A micro pump according to claim 30, wherein a main surface of the oscillating plate forms a wall of the pressure chamber.

32. A micro pump comprising:

a pressure chamber for accommodating a fluid;

an actuator which is capable of repeatedly pressurizing the fluid in the pressure chamber in accordance with a first prescribed manner and a second prescribed manner;

a first flow pass connected with the pressure chamber, wherein the fluid is capable of flowing through the first flow pass to and from the pressure chamber; and a second flow pass connected with the pressure chamber, wherein the fluid is capable of flowing through the second flow pass to and from the pressure chamber, wherein, under the first prescribed manner, a first area including the first flow pass has a first flow pass resistance when the fluid in the pressure chamber is pressurized, while a second area including the second flow pass has a second flow pass resistance that is greater than the first flow pass resistance when the fluid in the pressure chamber is pressurized, and wherein, under the second prescribed manner, the first area has a third flow pass resistance when the fluid in the pressure chamber is pressurized, while the second area has a fourth flow pass resistance that is smaller than the third flow pass resistance when the fluid in the pressure chamber is pressurized.

33. A micro pump according to claim 32, further comprising:

a driver, connected with the actuator, being capable of sequentially applying to the actuator voltage signals of a first waveform so that the actuator repeatedly pressurizes the fluid in the pressure chamber in accordance with the first prescribed manner, and being capable of sequentially applying to the actuator voltage signals of a second waveform that is different from the first waveform so that the actuator repeatedly pressurizes the fluid in the pressure chamber in accordance with the second prescribed manner.

34. A micro pump according to claim 33, wherein the first waveform comprises a rising time period during which an amplitude of the voltage signal is increased and a falling time period during which the amplitude of the voltage signal is decreased.

35. A micro pump according to claim 34, wherein the rising time period and the falling time period respectively require a first time period length and a second time length.

36. A micro pump according to claim 35, wherein the first time length is different from the second time length.

37. A micro pump according to claim 35, wherein the first waveform further comprises, between the rising time period and the falling time period, a keeping time period during which an amplitude of the voltage signal is maintained.

38. A micro pump according to claim 35, wherein the first time length and the second time length are identical.

39. A micro pump according to claim 38, wherein the first waveform has a shape of a sine wave.

40. A micro pump according to claim 32, wherein a cross sectional configuration of the first flow pass is identical to a cross sectional configuration of the second flow pass, and wherein a length of the first flow pass is different from a length of the second flow pass.

41. A micro pump according to claim 32, wherein a shape of the first flow pass is different from a shape of the second flow pass.

42. A micro pump according to claim 41, wherein at least one of the first flow pass and the second flow pass has a tapered shape.

43. A micro pump according to claim 41, wherein at least one of the first flow pass and the second flow pass has cross sectional configurations which change in a stepwise manner.

44. A micro pump according to claim 41, wherein at least one of the first flow pass and the second flow pass has an obstruction therein.

45. A micro pump according to claim 32, wherein the actuator comprises a piezoelectric element.

46. A micro pump according to claim 45, wherein the actuator further comprises:

an oscillating plate to which the piezoelectric element is disposed.

47. A micro pump according to claim 46, wherein a main surface of the oscillating plate forms a wall of the pressure chamber.

48. A micro pump comprising:

a pressure chamber for accommodating a fluid;

an actuator which is capable of repeatedly increasing and decreasing an internal pressure of the pressure chamber in accordance with a first prescribed manner;

a first flow pass connected with the pressure chamber, wherein the fluid is capable of flowing through the first flow pass to or from the pressure chamber; and a second flow pass connected with the pressure chamber, wherein the fluid is capable of flowing through the second flow pass to or from the pressure chamber, wherein, under the first prescribed manner, a flow through the first flow pass shows a laminar flow when the internal pressure is increased and shows a turbulent flow when the internal pressure is decreased, while a flow through the second flow pass shows a laminar flow when the internal pressure is increased and shows a laminar flow when the internal pressure is decreased.

49. A micro pump according to claim 48, further comprising:

a driver, connected with the actuator, being capable of sequentially applying to the actuator voltage signals of a first waveform so that the actuator repeatedly increases and decreases the internal pressure chamber in accordance with the first prescribed manner.

50. A micro pump according to claim 49, wherein the first waveform comprises a rising time period during which an amplitude of the voltage signal is increased and a falling time period during which the amplitude of the voltage signal is decreased.

51. A micro pump according to claim 50, wherein the rising time period and the falling time time period respectively require a first time length and a second time length.

52. A micro pump according to claim 51, wherein the first time length is different from the second time length.

53. A micro pump according to claim 50, wherein the first waveform further comprises, between the rising time period and the falling time period, a keeping time period during which an amplitude of the voltage signal is maintained.

54. A micro pump according to claim 51, wherein the first time length and the second time length are identical.

55. A micro pump according to claim 54, wherein the first waveform has a shape of a sine wave.

56. A micro pump as claimed in claim 48, wherein the actuator is further capable of repeatedly increasing and decreasing the internal pressure of the pressure chamber in accordance with a second prescribed manner, and wherein, under the second prescribed manner, a flow through the first flow pass shows a turbulent flow when the internal pressure is increased and shows a laminar flow when the internal pressure decreased, while a flow through the second flow pass shows a laminar flow when the internal pressure is increased and shows a laminar flow when the internal pressure is decreased.

57. A micro pump comprising:

a pressure chamber for accommodating a fluid;

an actuator having a driving element operably coupled to the pressure chamber, the actuator adapted to repeatedly increase and decrease an internal pressure of the pressure chamber in accordance with a first prescribed manner;

a first flow pass connected with the pressure chamber, wherein the fluid is capable of flowing through the second flow pass to or from the pressure chamber; and a second flow pass connected with the pressure chamber, wherein the fluid is capable of flowing through the second flow pass to or from the pressure chamber, wherein, under the first prescribed manner, a flow through the first flow pass shows a laminar flow when the internal pressure is increased and shows a turbulent flow when the internal pressure is decreased, while a flow through the second flow pass shows a laminar flow when the internal pressure is increased and shows a laminar flow when the internal pressure is decreased.

58. A micro pump according to claim 57, further comprising:

a driver, connected with the actuator, being capable of sequentially applying to the actuator voltage signals of a first waveform so that the actuator repeatedly increases and decreases the internal pressure of the pressure chamber in accordance with the first prescribed manner.

59. A micro pump according to claim 58, wherein the first waveform comprises a rising time period during which an amplitude of the voltage signal is increased and a falling time period during which the amplitude of the voltage signal is decreased.

60. A micro pump according to claim 59, wherein the rising time period and the falling time period respectively require a first time length and a second time length.

61. A micro pump according to claim 59, wherein the first time length is different from the second time length.

62. A micro pump according to claim 59, wherein the first waveform further comprises, between the rising time period and the falling time period, a keeping time period during which an amplitude of the voltage signal is maintained.

63. A micro pump according to claim 60, wherein the first time length and the second time length are identical.

64. A micro pump according to claim 60, wherein the first waveform has a shape of a since wave.

65. A micro pump as claimed in claim 57, wherein the actuator is further adapted to repeatedly increase and decrease the internal pressure of the pressure chamber in accordance with a second prescribed manner, and wherein, under the second prescribed manner, a flow through the first flow pass shows a turbulent flow when the internal pressure is increased and shows a laminar flow when the internal pressure is decreased, while a flow through the second flow pass shows a laminar flow when the internal pressure is increased and shows a laminar flow when the internal pressure is decreased.

* * * * *

UNITED STATES PATENT AND TRADEMARK OFFICE

CERTIFICATE OF CORRECTION

PATENT NO. : 6,716,002 B2
DATED : April 6, 2004
INVENTOR(S) : Kusunoki Higashino It is certified that error appears in the above-identified patent and that said Letters Patent is hereby corrected as shown below:

Column 7,
Line 57, after “and”, delete “.”.

Column 13,
Lines 31 and 32, after “first”, delete “flow pass”.
Line 33, delete “is changed”.
Line 40, after “first”, insert -- area --.

Column 15,
Line 21, after “chamber”, delete “,”, and insert -- ; --.

Column 18,
Line 23, after “pressure”, insert -- of the pressure --.
Line 64, delete “second”, and insert -- first --.

Column 20,
Line 11, delete “since”, and insert -- sine --.

Signed and Sealed this

Twenty-first Day of September, 2004

JON W. DUDAS
*Director of the United States Patent and Trademark Office*